United States Patent [19]

Shiraishi

[11] Patent Number: 4,631,040

[45] Date of Patent: Dec. 23, 1986

[54] CONSTRUCTION TOY SET

[75] Inventor: Masami Shiraishi, Tokyo, Japan

[73] Assignee: Tomy Kogyo Co., Inc., Tokyo, Japan

[21] Appl. No.: 683,248

[22] Filed: Dec. 18, 1984

[51] Int. Cl.[4] ..... A63H 17/00

[52] U.S. Cl. ..... 446/95; 446/94; 446/124

[58] Field of Search ..... 446/95, 94, 93, 96, 446/85, 124, 120, 121, 128, 471

[56] References Cited

U.S. PATENT DOCUMENTS

| | | | |
|---|---|---|---|
| 2,106,148 | 1/1938 | Kellner . | |
| 2,398,223 | 4/1946 | Gilbert | 446/94 |
| 3,651,597 | 3/1972 | Daenen | 446/124 |
| 3,996,692 | 12/1976 | Daenen | 446/95 X |
| 4,044,497 | 8/1977 | Bettens . | |

FOREIGN PATENT DOCUMENTS

| | | | |
|---|---|---|---|
| 994339 | 6/1965 | United Kingdom | 446/76 |

*Primary Examiner*—Mickey Yu

*Attorney, Agent, or Firm*—Herb Boswell

[57] ABSTRACT

A toy construction set has a variety of component parts including bases, houses, and auxiliary members. Male and female connecting elements attached to the respective components allow for assembly of the components in a variety of configurations. To connect the components, one or more of a first male connector which is formed as a truncated cone and a first female connector which is formed as a corresponding truncated boss, are frictionally fit to one another. The first male and female connectors are appropriately formed on the bases, housings, and auxiliary members. Further, a second connecting system utilizing a second female connector formed as a cylindrical opening and an elongated cylindrical element can be utilized to connect other of these components together. Utilizing the components of the invention, a variety of spacial configurations can be made, such as forming vehicle like trucks, helicopters, and construction equipment such as backhoes, forklifts, bulldozers, and the like.

12 Claims, 13 Drawing Figures

20
80
26
28
46
48
88
50
78
72
96
98
92
94
84
64
76
74
80
26
82
28
46
48
50

20

26
28
46
48
50
96
64
24
98
44
68
26
70
28
90
46
48
50

CONSTRUCTION TOY SET

BACKGROUND OF INVENTION

This invention is directed to a toy construction set having frictionally fit connectors which allow the toy to be easily assembled and disassembled by a child of a tender age.

A plurality of toy construction sets are known. These have been quite popular for generations and include erector set type toys wherein the metalic elements are attached together utilizing nuts and bolts, tinker toy type toys wherein wooden elements are connectable by inserting cylindrical members into cylindrical holes, block type toys having interlocking attaching members as well as many other similar types of toys.

The erector set said type toys and more modern versions of the same which utilize sophisticated elements, because of their complexity, are normally only enjoyed by children of at least grade school age. A small child does not have the necessary manual dexterity to assemble and disassemble the pieces of these types of toys and can become quite frustrated in playing with these types of toys.

Tinker type toys and other similar toys, while easier to use for the small child, are generally assembled into abstract shapes which do not directly correlate with real life objects in the child's environment.

Building block type toys are generally more useful for constructing houses, buildings, and the like. More modern adaptations of these building block type toys include certain elements such as wheels and the like which allow the child to build vehicles such as trucks and airplanes. However, these represent quite complex construction projects and, again, are not generally suitable for the small child of preschool age.

BRIEF DESCRIPTION OF THE INVENTION

In view of the above, it is the broad object of this invention to provide a construction type toy, directed to the preschool child, which is simple to use yet can be assembled into a variety of different objects, some of which correspond to objects found in the child's real life environment. It is a further object of this invention to provide a construction toy which utilizes only simple friction fitting interconnecting parts for assembly and disassembly. It is an additional object to provide a construction toy which, because of the engineering principles incorporated therein, is capable of a long and useful lifetime, yet is still of sufficient simplicity so as to be economically available to the consuming public.

These and other objects, as will become evident from the remainder of this specification, are achieved in a toy construction set which comprises at least one base, said base having a base moving means for moving said base on a support surface; said base including at least one connector of a first type; at least one housing; said housing including at least one connector of a second type; at least one connector of a third type; at least one connector of a fourth type; one of said first and said second type connectors being a first male connector and the other of said first and said second connectors being a first female connector; said first male connector shaped as a truncated conical element having a larger cross sectional dimension at its base than at its apex; said first female connector shaped as a hollow truncated conical boss having a larger cross sectional dimension at its apex than at its base; said first male connector sized to fit into and frictionally connect to said first female connector so as to temporarily connect said housing to said base; said connector of said third type including a first male connector further including an elongated cylindrical section projecting perpendicularly from the center of the base of said first male connector; said connector of said fourth type including a second female connector sized and shaped such that said elongated cylindrical section of said third type connector fits into and is temporarily contained in said second female connector; at least one auxiliary element, said auxiliary element including at least one of said connector of said fourth type; said base, said housing and said auxiliary member temporarily connectable together by said connectors of said first, said second, said third and said fourth types.

In the illustrative embodiment, a plurality of auxiliary elements are utilized and include auxiliary elements of different types. A first of these types would include, in addition to the second female connector, a first male connector. The second female connector would be located with respect to the first male connector such that it opens into the plane of the base of the first male connector. In essence, this provides a cap type member to fit on top of the elongated cylindrical element of the third type connector. The third type connector in the illustrative embodiment is, in essence, somewhat mushroomed in shape and when the auxiliary element described in this paragraph is attached to it, a barbell shaped unit is achieved.

In the illustrative embodiment, the housing can be connected to the base directly or it can be indirectly connected utilizing a connector of the third type. In addition, a plurality of auxiliary elements can be connected to either the base or the housing so as to form a variety of units. By incoporating wheels on the base, a variety of different vehicle type toys can be constructed utilizing elements of this construction toy. These include trucks, cranes, backhoes, helicopters, forklifts, and other similar vehicles.

BRIEF DESCRIPTION OF THE DRAWINGS

This invention will be better understood when taken in conjunction with the drawings wherein.

This invention utilizes certain principles and/or concepts as are set forth in the claims appended hereto. Those skilled in the toy arts will realize that these principles and/or concepts are capable of being utilized with a variety of embodiments which may differ from the embodiment utilized for illustrative purposes. For this reason this invention is not to be construed as being limited solely to the illustrative embodiment, but should only be construed in view of the claims.

DETAILED DESCRIPTION OF THE INVENTION

Figure 1:
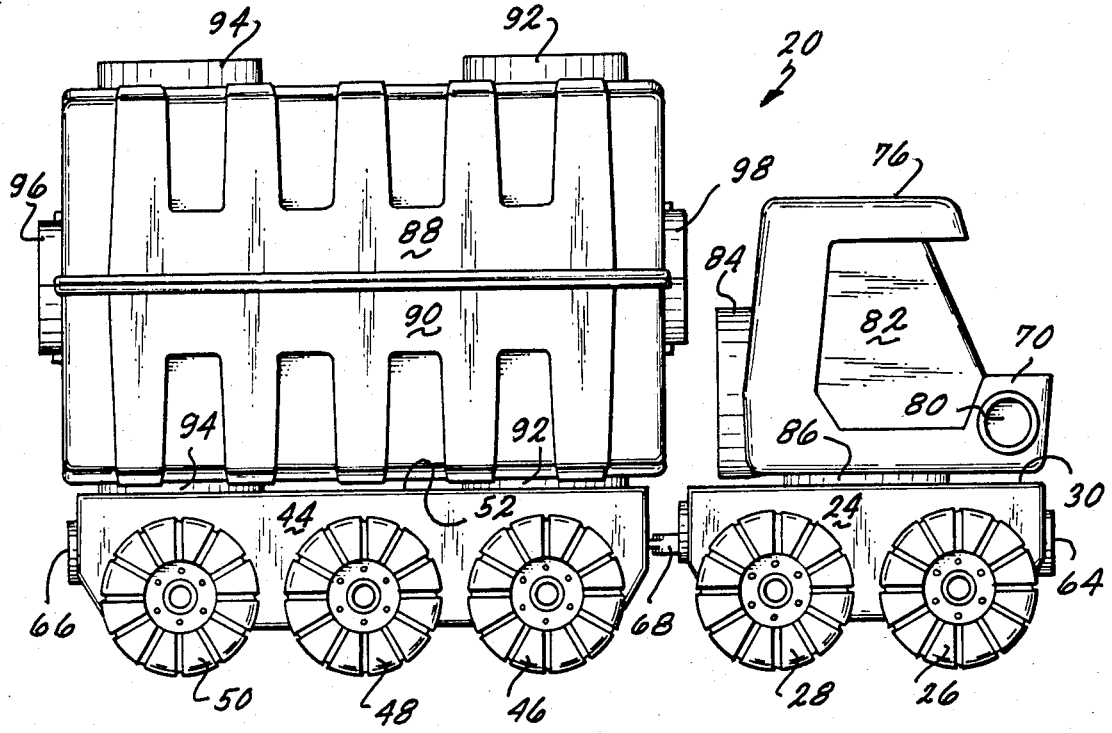
FIG. 1 is a right side elevational view of an embodiment of the invention.
Figure 2:
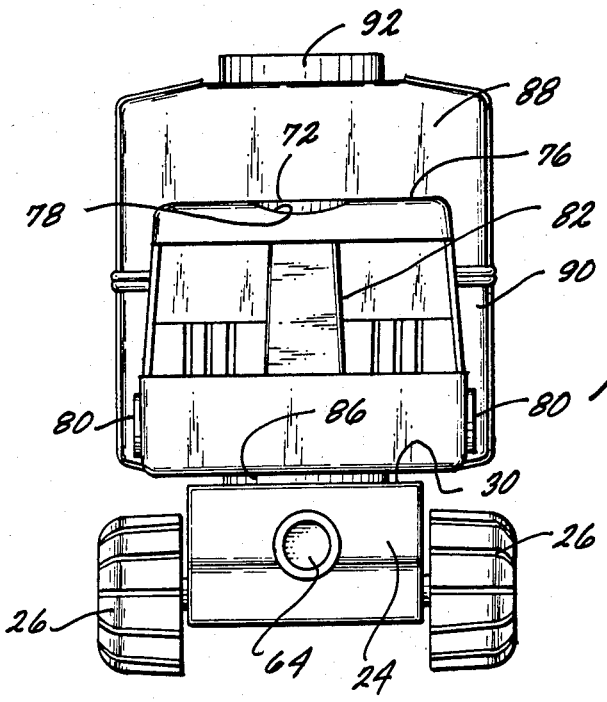
FIG. 2 is a front elevational view of the embodiment of FIG. 1.
Figure 3:
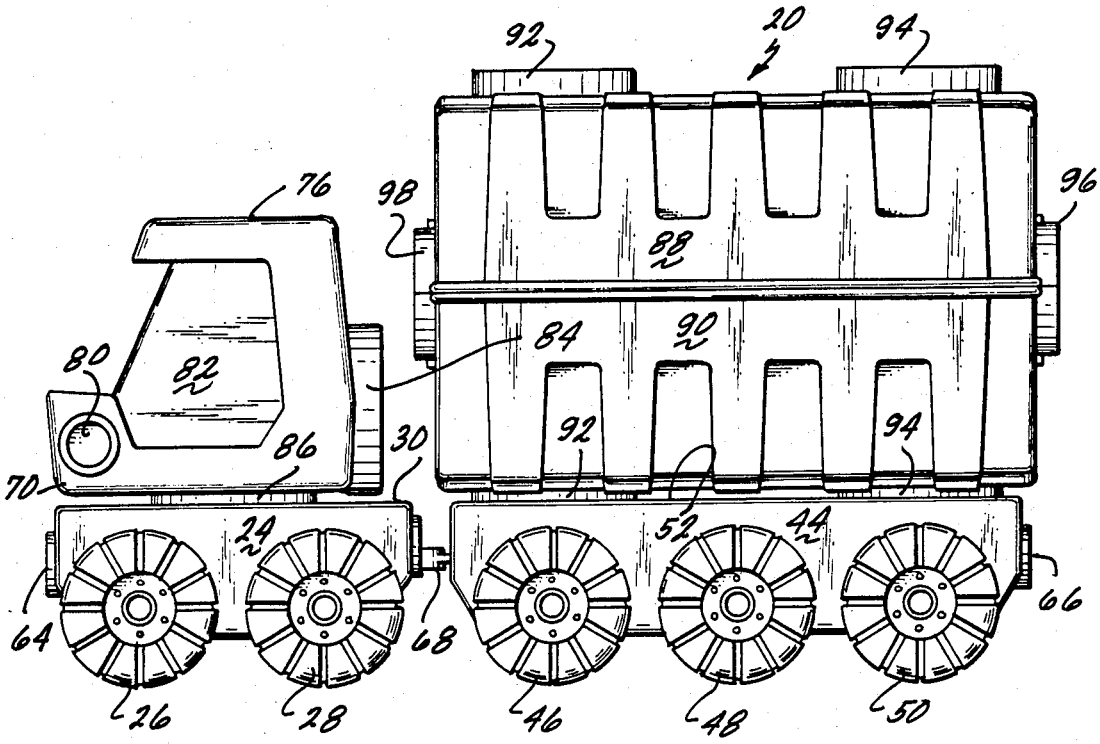
FIG. 3 is a left side elevational view of the embodiment of FIG. 1.
Figure 4:
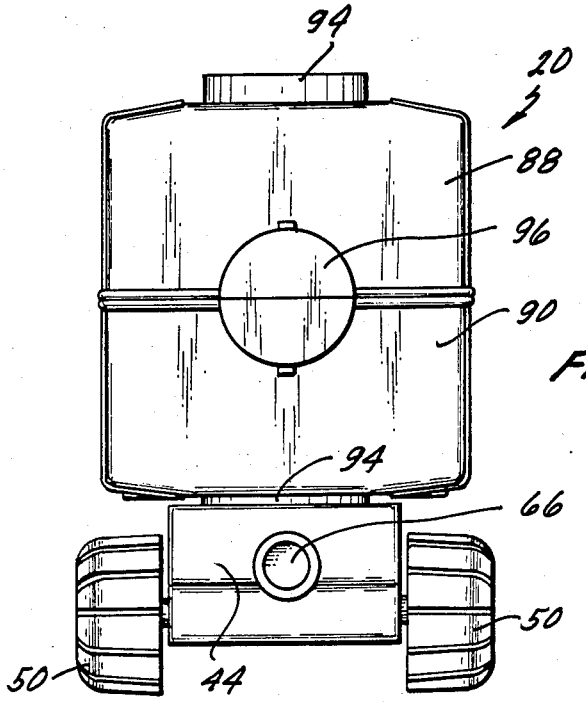
FIG. 4 is a rear elevational view of the embodiment of FIG. 1.
Figure 9:
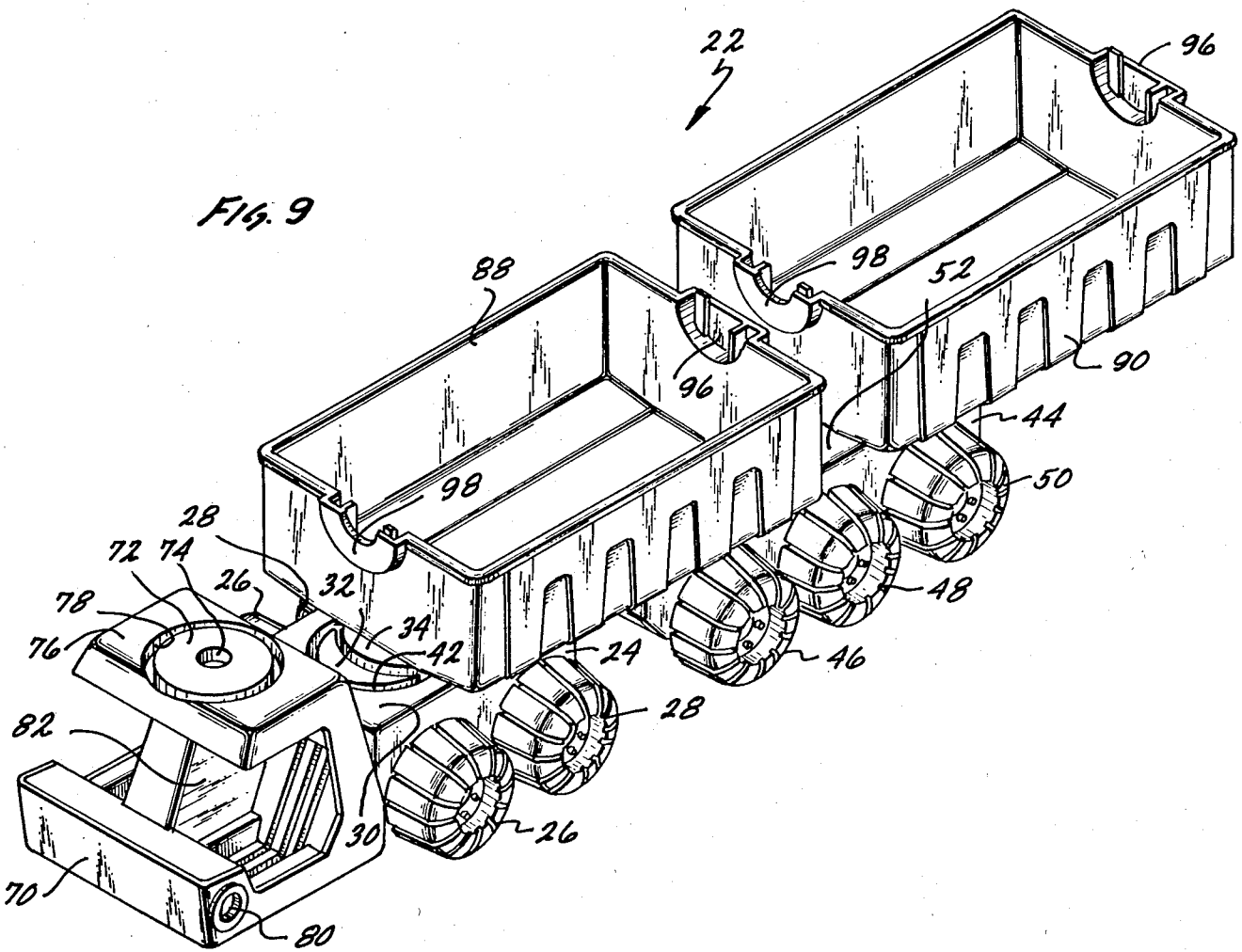
FIG. 9 is an isometric view showing the components of FIG. 1 rearranged in a different spacial configuration.

In the construction toy of this invention, a plurality of components can be combined in a variety of arrangements to form a variety of different structures. Two of these structures are shown in FIGS. 1 and 9. For the purposes of this specification, the invention is considered as a unified toy, however, for ease in understanding of the drawings, the arrangement of parts shown in FIG. 1 will be identified as toy vehicle 20, whereas the arrangement of parts shown in FIG. 9 will be identified as toy vehicle 22. In essence, the same parts are utilized for these two vehicles, they are simply rearranged in different configurations.

Figure 11:
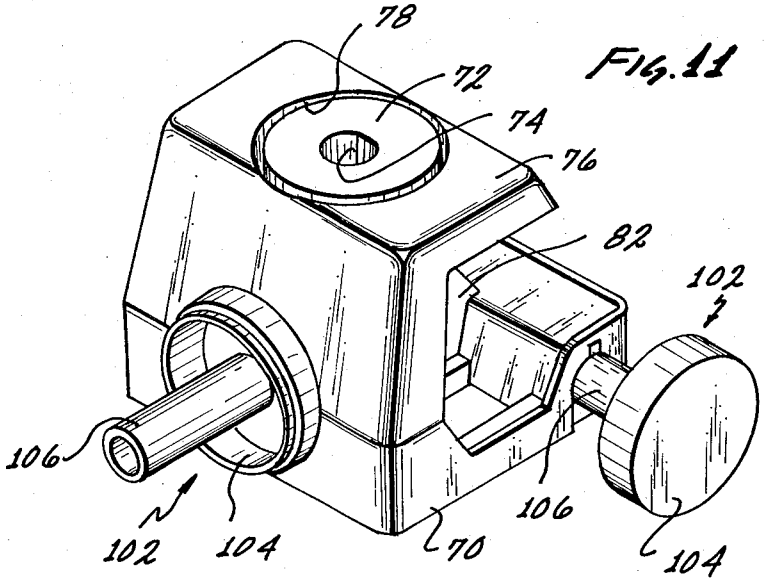
FIG. 11 is an isometric view looking toward the back of the component in the lower left hand corner of FIG. 9.
Figure 10:
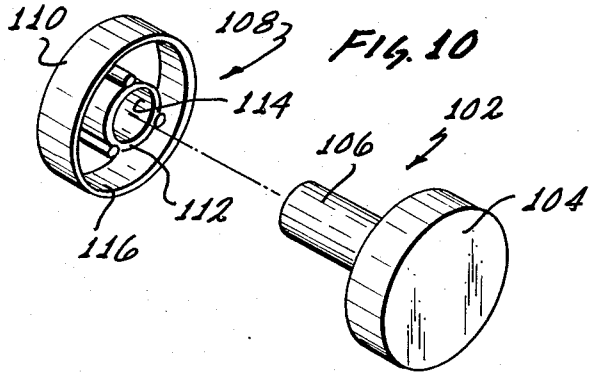
FIG. 10 is an isometric view of a connector utilized with the invention.
Figure 12A:
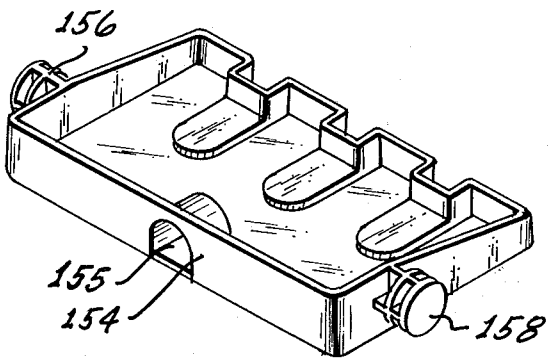
FIG. 12 and FIG. 12*a* are isometric views of further components of the invention.
Figure 12:
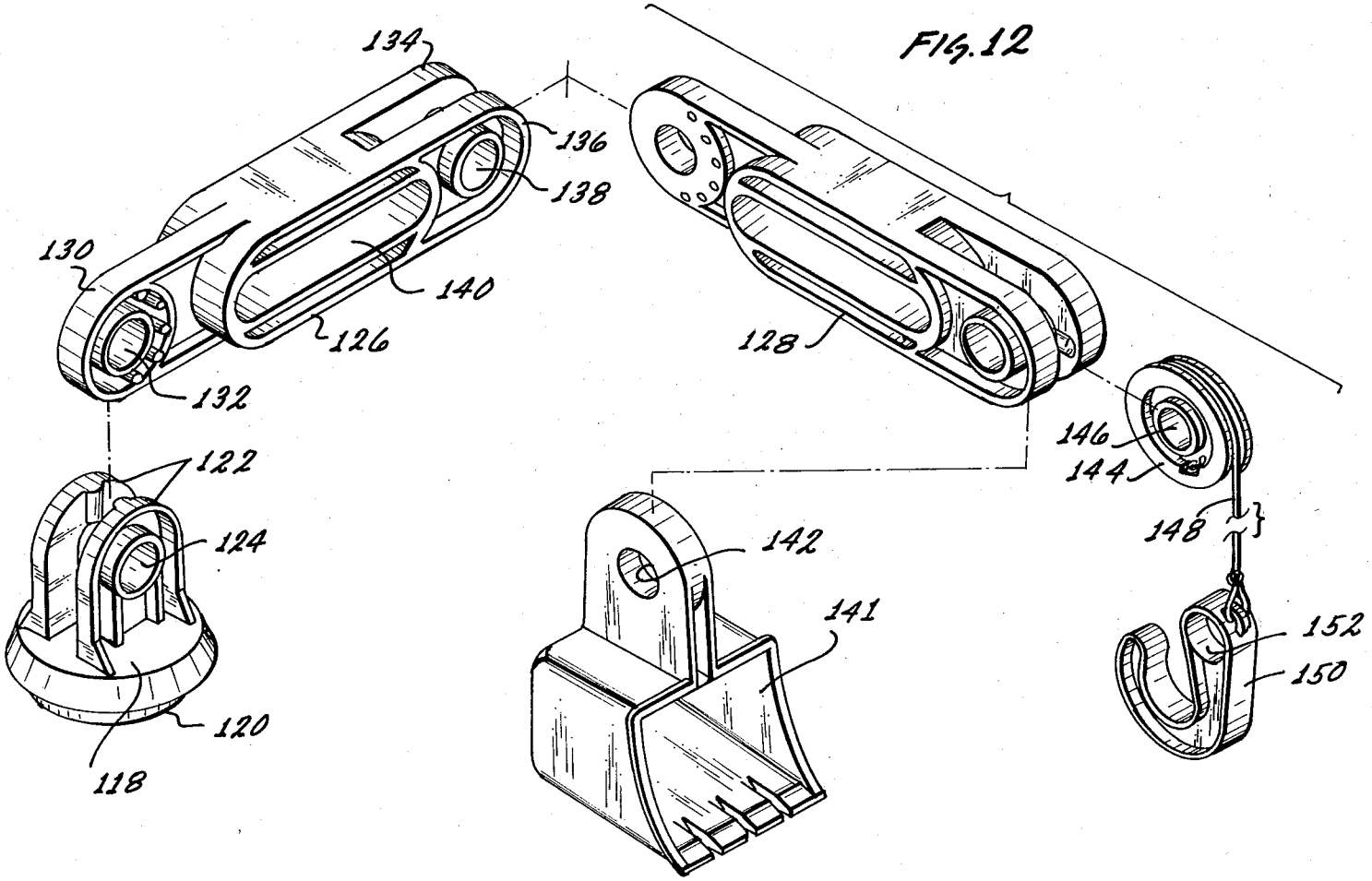

Other component parts best seen in FIGS. 10, 11, and 12, can also be utilized with the component parts which are utilized to construct the toy vehicles 20 and 22. Utilizing these toy vehicles, a small child can put together a variety of toy vehicles including cargo trucks such as the toy vehicle 20, carrier trucks such as the toy vehicle 22, cranes, forklifts, front loaders, steamshovels, helicopters, utility vehicles, and many other combinations as will only be governed by the child's imagination.

The component parts of this invention are put together utilizing simple friction fittings which are easily manipulated by children of preschool age. Because the parts simply friction fit together, very little manipulative dexterity is needed, such that the construction toy of this invention is aptly suited for preschool age children. Generally, the parts are of such size and dimension that they are easily grasped by the hands of a small child. Because a construction toy of this invention can be repeatedly assembled and disassembled, it contributes toward increasing the hand/eye coordination of the child, and the child's manual dexterity, as well as allowing for the expression of the child's creativity in assembling the component parts of the toy in a variety of spacial configurations.

Referring now, basically, to FIGS. 1 through 8, the construction toy of the invention includes a first base 24 which has a first and second set of wheels 26 and 28 respectively such that it is a four wheeled vehicle type base. It includes an upper surface 30 having a complex pattern formed therein.

The pattern formed in the upper surface 30 of the base 24 is, in effect, that of three overlapping male bosses, the forward one being comprised of parts 32, 34, and 36, the middle one comprising parts 34, 36, and 38, and the rear one comprising parts 36, 38, and 40. It can be seen by simply looking at these three groups of parts, that the three concentric upstanding male bosses which are formed are overlapping with the centers of each of the circular male bosses lying in a foreaft line along the base 24.

Prior to describing further parts of the construction toy of the invention, some general terms will be defined. The construction toy of the invention utilizes certain male and female connectors for attaching parts together. Certain of these connectors comprise first male connectors. An example of these would be the three bosses formed from parts 32 through 40 located on the first base 24. Other parts also constitute first male connectors and will be identified below. In addition to these first male connectors, there are first female connectors which are sized and shaped so as to mate with the first male connectors. Further, there are elongated cylindrical connectors described below which fit into smaller second female connectors.

The first male and first female connectors are shaped as truncated cones or conic sections. The first male connector is the outside surface of such a truncated cone or conic section, and the first female connector would be the inside surface of such a truncated cone or conic section. On the first male connectors, the diameter through a cross section of the cone, across the apex of the cone, is smaller than the diameter across the base. The first female connector is shaped in a similar manner such that the first male connectors can fit into and frictionally engage against the inside walls of the female connectors.

The second female connectors are shaped as cylindrical openings and are located on a variety of different parts as hereinafter identified. They can accept an elongated cylindrical section of a further male connector. The size of the opening of the second female connector compared to the cross sectional cylindrical size of the further male connector, is such that there is a slight frictional fit between the same, but the male connector can be rotated within the female connector. On certain of these second female connectors, the circumferential round surface at one point in the connector, is flattened out such that a slightly tighter frictional fit is formed in these connectors. This generally holds the elongated cylindrical male connector in a tighter fit in these connectors but still allows for ease for insertion and removal of the male connectors from the second female connectors.

In addition to the above identified parts, one further connector which forms a specific function is present and will be identified individually. In certain instances, the first male connectors are recessed into a surface such as the male connector formed of parts 32, 34, and 36 in the upper surface 30 of the base 24. The material of the base 30 is cut away forming a groove, such as groove 42, between the remainder of the surface and the male connector. The groove is of a sufficient size, however, that any female connector easily fits within the groove and the frictional fit is between the male connector and not the other portions of the surface such as upper surface 30.

A second wheeled base 44 has three sets of wheels identified by numerals 46, 48, and 50. These sets of wheels, as well as the sets of wheels 26 and 28, are appropriately mounted on axles not numbered or shown which extend through either the first base 24 or the second base 44 allowing the individual wheels of the sets of wheels 26, 28, 46, 48 and 50 to rotate so as to allow for rolling of the bases 24 and 44 on an appropriate support surface.

Located in the upper surface 52 of the second base 44 are truncated conic bosses 54, 56, and 58. These all serve as first male connectors. The boss 56 has an enlarged hollow interior allowing for placement of a small figurine or the like which could be utilized in playing with the toy construction set of the invention.

The bosses 54 and 58 each include an opening 60 and 62 therein respectively which form second female connectors. Thus, items can be attached to the second base 44 in two ways, either utilizing the first male connectors formed by the bosses 54, 56, and 58, or the second female connectors formed by the openings 60 and 62.

Formed on one foreaft edge of the first base 24 is an opening 64 which forms a second female connector. In a like manner, formed on one foreaft edge of the second base 44, is an opening 66 which also serves as a second female connector. The second base 44 includes a clip member 68 which serves as a further connector. It attaches to a small peg not numbered or shown on the first base 24 so as to form a clip like connection between the first and second bases 24 and 44 for forming vehicles such as the toy vehicle 20 shown in FIGS. 1 through 8.

Figure 8:
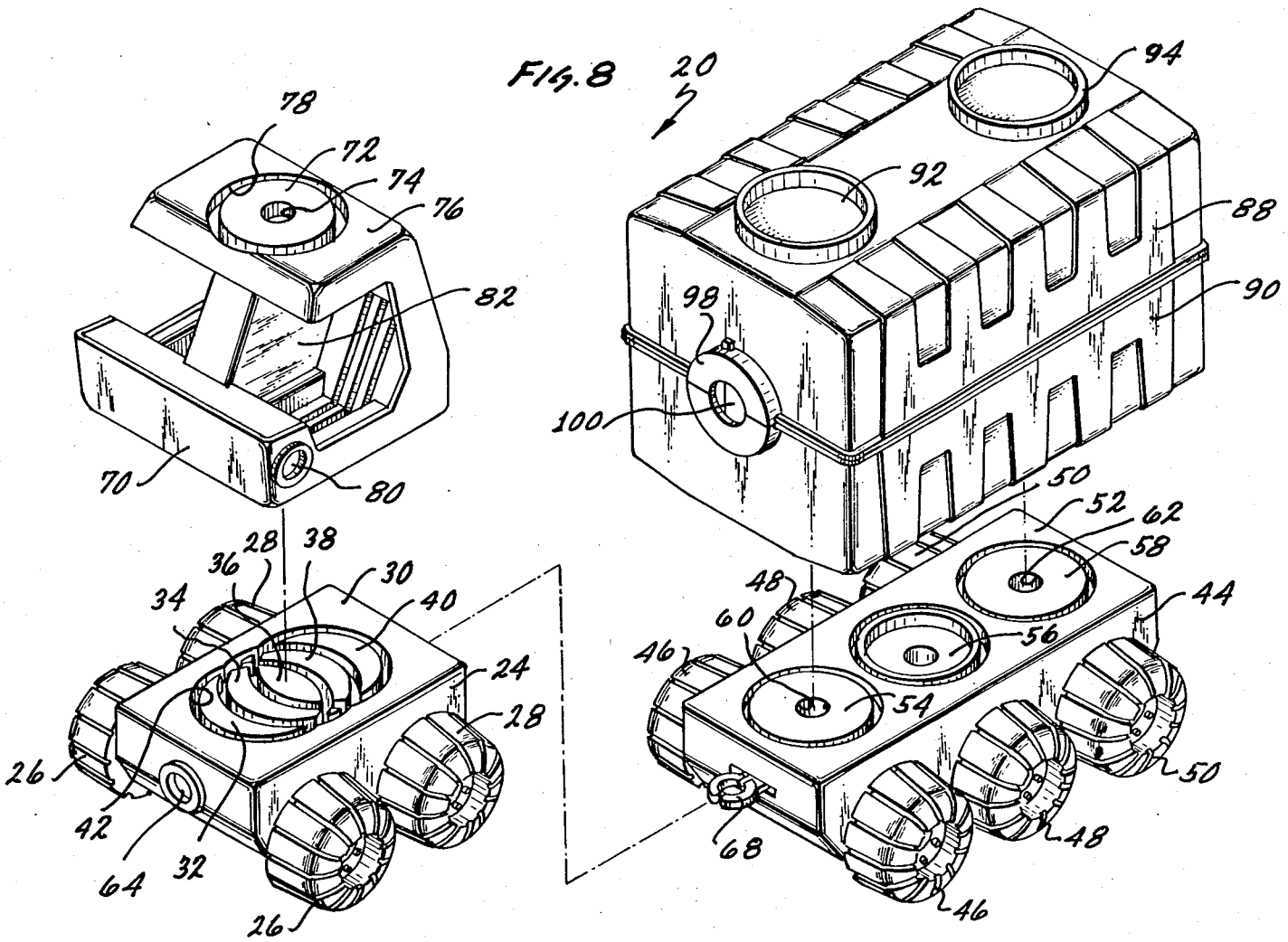
FIG. 8 is an exploded isometric view of components of the embodiment of FIG. 1.

A first housing 70 is seen attached to the first base 24 in FIGS. 1 through 7 and is exploded away from that base in FIG. 8. It is also attached to the first base 24 in FIG. 9, but a different method of attachment is utilized for that figure and will be discussed below. The first housing 70 includes a boss 72 on its upper surface which serves as a first male connector. The boss 72 includes an opening 74 in its center which serves as a second female connector. Again, the boss 74 is recessed into the upper surface 76 of the first housing 70, but a groove 78 surrounding it is of a sufficient width such that it, in fact, serves as a male connector and not a female connector.

Located on both the right and left hand sides of the upper housing 70 are openings collectively identified by the numeral 80 which serve as second female connectors.

The first housing 70 includes a cab 82 for placement of small figurines. The cab 82 forms a chamber within the first housing 70 and as is evident from viewing the drawings, is provided with open side and front walls allowing ingress and egress into the chamber formed by the cab 82.

The first housing 70 includes an open boss 84 on its back, as well as an identical open boss 86 on its bottom. Both of these have interior truncated conical surfaces and serve as the first female connectors for connecting to the first male connectors. As is evident from FIGS. 1 through 7, the open boss 86 on the first housing 70, can be utilized to connect the first housing 70 to the first base 24. It could be connected to any of the segmated bosses formed by the parts of the bosses 32, 34, 36, or 34, 36, 38, or 36, 38, and 40. In a like manner, the first housing 70 can be connected to the second base 44 by attaching it via either of the open bosses 84 to 86 to any of the truncated bosses 54, 56, or 58 on the second base 44. It is further evident, that while the surface 76 was referred to as the upper surface, it, in fact, could be a surface other than the upper surface if, in fact, the boss 84 were utilized to connect the first housing 70 to one of the bases 24 or 44.

Two identical open housings 88 and 90 can be utilized to form a container like structure as is seen in FIGS. 1 through 7, or open flat bed type bins as is seen in FIG. 9. The two components 88 and 90 are, in fact, identical, and can be utilized in pairs if the closed type container as seen in FIGS. 1 through 8 is to be formed.

Figure 5:
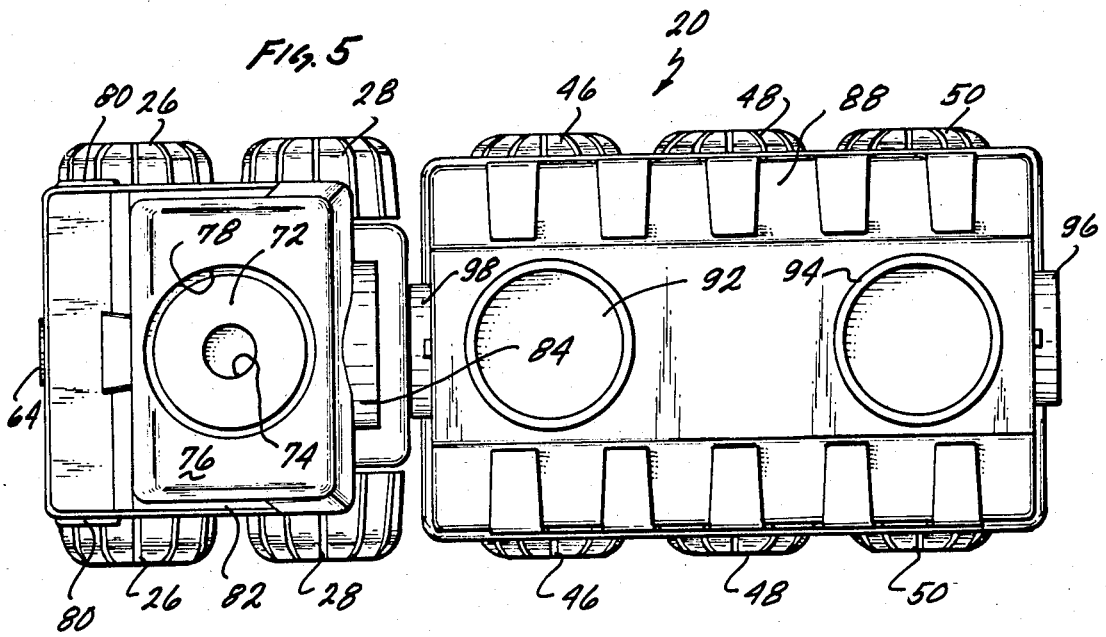
FIG. 5 is a top plan view of the embodiment of FIG. 1.
Figure 6:
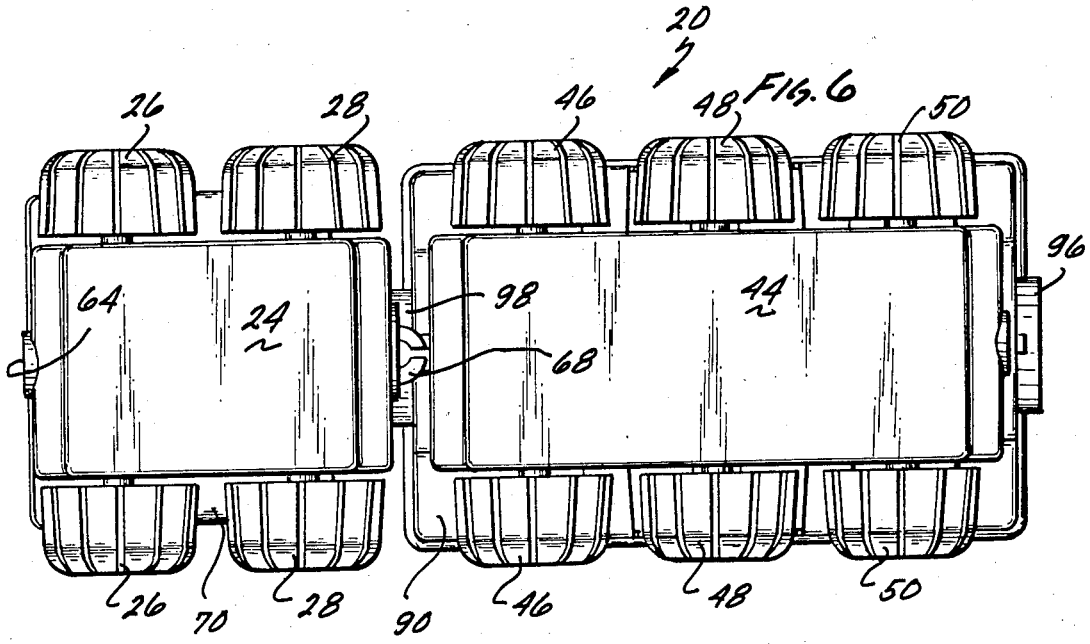
FIG. 6 is a bottom plan view of the embodiment of FIG. 1.
Figure 7:
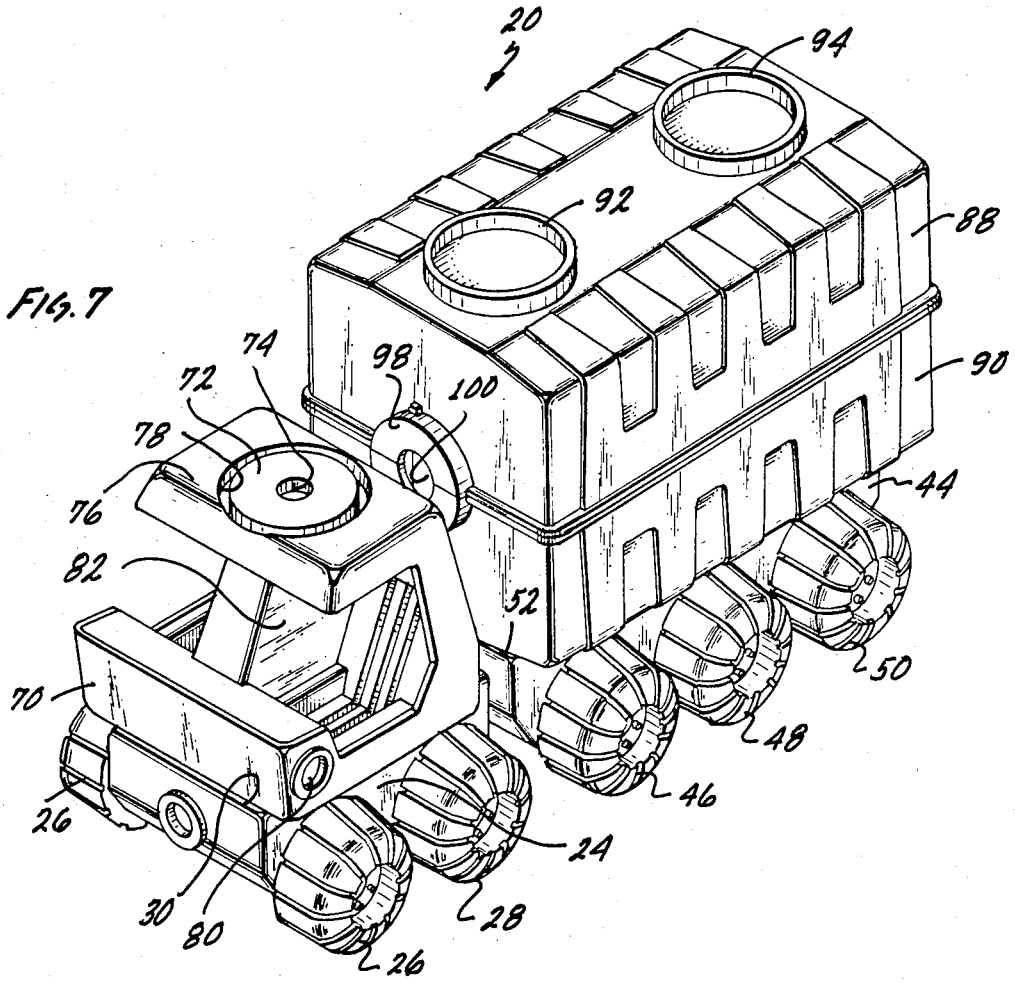
FIG. 7 is an isometric view of the embodiment of FIG. 1.

As is best seen in FIGS. 1 and 5, the housing 88 includes two open bosses 92 and 94 which have interior truncated conical surfaces and, thus, these bosses 92 and 94 serve as first female connectors. Likewise, the housing 90 has two identical bosses, also identified by the numerals 92 and 94. This allows the attachment of the housings 88 and 90 to either of the bases 24 or 44. As is evident in FIG. 9, the housing 88 is connected to both of the bases 24 and 44 by connecting one of the open bosses 92 to base 24 and a further open boss 94 to the other base 44. In this spacial configuration of the construction toy of the invention, the housing 90 is connected by only one of its bosses 92 and 94 to the second base 44.

Aside from the open bosses 92 and 94, the housings 88 and 90 include on one end thereof a hemispheric section of a boss 96. When the housings 88 and 90 are combined to form a container as per FIG. 1, the boss 96 is complete. The boss 96 serves as a further first male connector. When the boss 96 is utilized as a first male connector, the closed container formed by the housings 88 and 90 can be oriented 90° to that seen in FIG. 1. That is, it can be rotated such that its elongated dimension is vertical instead of horizontal.

On the other end of each of the housings 88 and 90, are further hemispheric sections of a further boss 98. The boss 98 is slightly reduced in size with respect to the bosses which form the first male connectors, and in fact, is designed to fit the enlarged hollow area within the truncated conical boss 56 on the second base 44. It is primarily utilized when the combined housings 88 and 90 are made to form a container which is vertically oriented on the second base 44. The boss 98 further includes an opening 100 within its center which serves as a second female connector.

Referring now to FIG. 10, a connecting element 102, somewhat mushroom shaped, includes a cap 104 formed as a truncated conical surface serving as a first male connector. It further includes an elongated cylindrical stem 106 which is of a diameter so as to mate with the second female connectors. A further disk like member 108 has a cap 110 which again serves as a first male connector. It includes a hollow boss 112 on its under side which serves as a second female connector. The opening of the boss 114 is in the plane of the edge 116 of the cap 110.

The connecting element 102 can be utilized singularly by itself connecting either to one of the first female connectors via the cap 104 or one of the second female connectors via the stem 106. In a different manner of construction, it can be utilized in conjunction with the disk 108 to form a linking unit.

In FIG. 11, one of the connecting elements 102 is shown attached to one of the openings 80 of the first housing member 70. A further of the connecting elements 102 is shown attached to the open boss 84 on the "rear" surface of the first housing 70.

When utilizing one of the connecting elements 102 as per the connection with the boss 84 in FIG. 11, the stem 106 of the connecting element 102 is then available for insertion into one of the second female connectors such as the female connector 64 on the first base 24. The first housing member 70 is, in fact, so connected to the first base 24 in this manner in FIG. 9. This provides somewhat of a low slung cab like look to the vehicle which is created when this type of construction is utilized.

The connecting elements 102 as well as the disk 108 are, in fact, a first of many auxiliary elements which can be utilized with the other parts of the construction toy of the invention. Other auxiliary parts are shown in FIG. 12.

A bifurcated slightly elongated member 118 has a hollow boss 120 which serves as a first female connector. It includes two ears collectively identified by the numeral 122 which each include an opening collectively identified by the numeral 124 therein. The openings 124 are, in fact, second female connectors. The member 118 can be positioned directly on either the first or second bases 24 or 34, or onto the first housing member 70, or either of the housing members 88 or 90 by attaching to any appropriate first male connectors located on these parts. Further, it can be connected to the cap 104 of the connecting element 102, or to a disk 108.

Also seen in FIG. 12 are two elongated members 126 and 128. They, in fact, are duplicates of each other and, therefore, only one of them will be described. A first ear 130 on one end of the member 126 includes an opening 132 serving as a second female connector. Two bifurcated ears 134 and 136 on the opposite ends each include an opening 138 with the opening 138 also serving as a second female connector. Additionally, an elongated slot 140 runs down the center of the elongated member 128. Slot 140 is sized so as to allow for insertion of the stem 106 to the connecting element 102 therein. Normally the elongated members 126 and 128 are connected together utilizing the single ear 130 of one of these members inbetween the double ears 134 and 136 of a further of these members. These are then joined with one of the connecting elements 102 in conjunction with a disk 108. Additionally, the single ear 130 fits between the bifurcated ears 122 of the member 118 and can be joined to it by a connecting element 102.

A shovel 141 having an opening 142 thereon, formed as a second female connector, can be joined to the ears 134 and 136 of one of the elements 126 or 128. Likewise, a spool 144 with an opening 146 formed therein, which also is a female connector, can be joined either to one of the elements 126 or 128 or the element 118. A flexible member 148 joins the spool 144 to a hook 150 which has an opening 152 formed therein which is also a second female connector. The hook 150 can be directly joined to one of the elements 126, 128, or 118 via the opening 152, or it can be indirectly joined via the spool 144.

Backhoes and steam type shovels can be formed utilizing the elements 118, 126, 128, and 141, or cranes can be formed utilizing the elements 118, 126, 128, 144, and 150. A wrecking or towing truck can be formed utilizing the element 118, 126, and possibly 128, in conjunction with only the hook 150.

A helicopter can be formed by passing the stem 106 of one of the connecting elements 102 through the elements 126 and 128, and into the opening 74 in the first housing 70. Multiple carrying vehicles, trucks, carriers, and the like, can be formed as per FIGS. 1 through 9.

Utilizing a further flat element 154 having an opening 155 formed in one of its edges, and two bosses 156 and 158 formed on other of its edges, other constructions can be completed. The opening 155 serves as a second female connector and the bosses 156 and 158 are the same diameter as the stem 106 of the connecting elements 102 such that they fit within any second female connector such as the openings 132 on the elements 126 or the openings 80 on the first housing 70. With the flat element 154, bulldozer toys can be constructed by suspending the element 154 between the two elements 126 and 128, and attaching them via the openings 80 to the first housing 70. Further, a forklift can be created by utilizing one of the connecting elements 102 passing through the elongated slot 140 of the element 126 and attaching the element 126 via one of the connecting elements 102 to the opening 64 on the first base 24.

It can be seen that a wide variety of toys can be formed utilizing the construction toy of the invention. The parts of the construction toy of the invention lend themselves to forming a variety of shapes which the child can directly correlate with real life machines, vehicles, and the like. The auxiliary members including connecting element 102 with or without the disk 108, the member 118, the members 126, 128, 141, 144, 150, and 154 can be utilized in a variety of permutations and combinations with either the bases 24 or 44 directly, or by interspacing one of the housings 70, 88, and 90 between.

I claim:

1. A toy construction set which comprises:

at least one base, said base having a base moving means for moving said base on a support surface;

said base including at least one connector of a first type;

at least one housing;

said housing including at least one connector of a second type;

one of said first and said second type connectors being a first male connector and the other of said first and said second connectors being a first female connector;

said first male connector shaped as a truncated conical element;

said first female connector shaped as a hollow truncated conical boss;

said first male connector sized to fit into and frictionally connect to said first female connector so as to temporarily connect said housing to said base;

at least one mushroom shaped element comprising a connector of a third type, said connector of said third type independent of each of said base and said housing and including a first male connector and, further, including an elongated cylindrical section projecting perpendicularly from the center of the base of said first male connector;

said housing including at least one opening located on said housing and forming a connector of a fourth type, said connector of said fourth type sized and shaped such that said elongated cylindrical section of said third type connector fits into and is temporarily contained in said fourth type connector;

said base and said housing temporarily connectable by said connectors of said first, said second, said third and said fourth types.

2. The toy of claim 1 including:

at least one auxiliary member, said auxiliary member including at least one opening located on said auxiliary member, said opening on said member forming a further connector of said fourth type.

3. The toy of claim 1 including:

at least one auxiliary member, said auxiliary member includes a first male connector having an opening formed thereon so as to open along the plane of the base of said conical element of said first male connector, said opening forming a further connector of said fourth type.

4. The toy of claim 2 wherein:

said auxiliary member includes an element having ends and including said at least one opening being located at one of said ends.

5. The toy of claim 4 wherein:

said element includes at least one further opening located at the other of said ends of said element, said further opening forming a further connector of said fourth type.

6. The toy of claim 4 wherein:

said element includes at least one of said first female connectors at the other of said ends of said element.

7. The toy of claim 1 wherein:

said base moving means comprises a plurality of wheels rotatably attached to said base such that said base is capable of rolling on said support surface.

8. The toy of claim 1 wherein:

said base includes at least two first male connectors.

9. A toy construction set which comprises:

at least one base, said base having a base moving means for moving said base on a support surface;

said base including at least one connector of a first type;

at least one housing;

said housing including at least one connector of a second type;

one of said first and said second type connectors being a first male connector and the other of said first and said second connectors being a first female connector;

said first male connector shaped as a truncated conical element;

said first female connector shaped as a hollow truncated conical boss;

said first male connector sized to fit into and frictionally connect to said first female connector so as to temporarily connect said housing to said base;

at least one mushroom shaped element comprising a connector of a third type, said connector of said third type independent of each of said base and said housing and including a first male connector and, further, including an elongated cylindrical section projecting perpendicularly from the center of the base of said first male connector;

said housing including at least one opening located on said housing and forming a connector of a fourth type, said connector of said fourth type sized and shaped such that said elongated cylindrical section of said third type connector fits into and is temporarily contained in said fourth type connector;

said base and said housing temporarily connectable by said connectors of said first, said second, said third and said fourth types;

said base including at least two first male connectors;

said first male connectors are positioned so as to be overlapping one on the other with the central axis of each of the conical elements of each of said first male connectors displaced from the central axis of any of the other said conical elements.

10. The toy of claim 1 wherein:

said housing includes chamber means for temporarily holding an object, said chamber means located within said housing and further including at least one opening in said housing opening into said chamber means for providing egress and ingress into said chamber means.

11. A toy construction set which comprises:

at least one base, said base having a base moving means for moving said base on a support surface;

said base including at least one connector of a first type;

at least one housing;

said housing including at least one connector of a second type;

one of said first and said second type connectors being a first male connector and the other of said first and said second connectors being a first female connector;

said first male connector shaped as a truncated conical element;

said first female connector shaped as a hollow truncated conical boss;

said first male connector sized to fit into and frictionally connect to said first female connector so as to temporarily connect said housing to said base;

at least one mushroom shaped element comprising a connector of a third type, said connector of said third type independent of each of said base and said housing and including a first male connector and, further, including an elongated cylindrical section projecting perpendicularly from the center of the base of said first male connector;

said housing including at least one opening located on said housing and forming a connector of a fourth type, said connector of said fourth type sized and shaped such that said elongated cylindrical section of said third type connector fits into and is temporarily contained in said fourth type connector;

said base and said housing temporarily connectable by said connectors of said first, said second, said third and said fourth types;

a plurality of auxiliary members;

a first portion of said plurality of auxiliary members including a first male connector having an opening formed thereon so as to open along the plane of the base of said conical element of said first male connector, said opening forming a further connector of said fourth type;

a plurality of said connectors of said third type equal to the number of said first portion of said plurality of auxiliary members;

together one of said first portion of said plurality of auxiliary members and one of said connectors of said third type forming a connector pair.

12. The toy of claim 11 including:

a second portion of said plurality of auxiliary members;

said second portion of said plurality of said auxiliary members including elements having ends and including at least one further opening located in at least one of said ends of each of said elements such that said elongated cylindrical section of said connectors of said third type forming said connecting pairs is positionable through one of said further openings in said second portion of said plurality of auxiliary members.

* * * * *